US008382167B2

(12) United States Patent
Kargilis et al.

(10) Patent No.: US 8,382,167 B2
(45) Date of Patent: Feb. 26, 2013

(54) LIFTGATE LATCH LINEAR CABLE SWITCH

(75) Inventors: John S. Kargilis, Northville, MI (US); James M. Lemens, Ann Arbor, MI (US); Gene E. Compton, Clinton Township, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 908 days.

(21) Appl. No.: 12/187,440

(22) Filed: Aug. 7, 2008

(65) Prior Publication Data

US 2010/0032965 A1 Feb. 11, 2010

(51) Int. Cl.
*E05C 3/06* (2006.01)

(52) U.S. Cl. ..... 292/216; 200/61.62

(58) Field of Classification Search ..... 292/336.3, 292/347, DIG. 29

See application file for complete search history.

(56) References Cited

U.S. PATENT DOCUMENTS 3,734,230 A * 5/1973 Tanaka ..... 180/272
3,758,736 A * 9/1973 Tanaka ..... 200/557
3,965,316 A * 6/1976 Olson ..... 200/452
4,033,616 A * 7/1977 Sheesley ..... 292/216
4,325,668 A 4/1982 Julian et al.
4,762,348 A * 8/1988 Matsumoto ..... 292/201
5,460,100 A * 10/1995 Gowda et al. ..... 105/341
5,758,762 A * 6/1998 Aulmann ..... 200/332
5,832,669 A * 11/1998 Mizuki et al. ..... 49/360
5,904,394 A * 5/1999 Dilluvio et al. ..... 296/121
5,982,126 A * 11/1999 Hellinga et al. ..... 318/468
6,050,028 A * 4/2000 Nishimura et al. ..... 49/280
6,242,706 B1 * 6/2001 Miyata ..... 200/537
6,256,932 B1 * 7/2001 Jyawook et al. ..... 49/503
6,404,078 B1 * 6/2002 Thomas et al. ..... 307/115
6,576,854 B2 * 6/2003 Yamanaka et al. ..... 200/302.1
6,653,581 B2 * 11/2003 Bassi ..... 200/61.62
6,717,084 B1 * 4/2004 Lu ..... 200/462
6,901,704 B2 * 6/2005 Sakaue et al. ..... 49/340
7,156,447 B2 * 1/2007 Watanabe ..... 296/146.4
7,183,733 B2 * 2/2007 Suzuki et al. ..... 318/282
7,501,595 B2 * 3/2009 Dimig et al. ..... 200/61.62
7,723,935 B2 * 5/2010 Kneller et al. ..... 318/286
2005/0115810 A1 * 6/2005 Spies ..... 200/61.62

* cited by examiner

*Primary Examiner* — Gary Estremsky
(74) *Attorney, Agent, or Firm* — Ralph E. Smith

(57) ABSTRACT

A latch system for a liftgate of a motor vehicle. The system includes a handle rotatable relative to the liftgate. The system also includes a switch having a first contact biased apart from a second contact by a biasing member. The first contact is movable relative to the second contact to close the switch upon rotation of the handle. The system further includes a power actuation system in communication with and responsive to the switch to move the liftgate from the closed position to the opened position when the switch is in the closed position.

13 Claims, 5 Drawing Sheets

LIFTGATE LATCH LINEAR CABLE SWITCH

FIELD

The present disclosure relates to liftgate systems for motor vehicles, and more particularly to a liftgate latch linear cable switch.

BACKGROUND

The statements in this section merely provide background information related to the present disclosure and may not constitute prior art.

Many motor vehicles include rear cargo compartments that are accessible by a liftgate. In one example, sport utility vehicles (SUV)s generally include a liftgate that enables access to a rear cargo compartment from the exterior of the motor vehicle. Generally, a liftgate includes a graspable portion that when actuated releases the liftgate so that the liftgate may be pivoted or rotated: into an opened position, via pneumatics, thereby enabling the operator to access the rear cargo compartment.

SUMMARY

The present invention provides a latch system for a lifegate of a motor vehicle. The system includes a handle rotatable relative to the liftgate. The system also includes a switch having a first contact biased apart from a second contact by a biasing member. The first contact is movable relative to the second contact to close the switch upon rotation of the handle. The system further includes a power actuation system in communication with and responsive to the switch to move the liftgate from the closed position to the opened position when the switch is in the closed position.

Also provided is a latch system for a liftgate of a motor vehicle. The system includes a latch that couples the liftgate to the motor vehicle when the liftgate is in a closed position. The system also includes a handle rotatable relative to the liftgate and in communication with the latch to uncouple the liftgate from the motor vehicle upon rotation of the handle. The system also includes a switch including a first contact spaced apart from a second contact in a first, opened position. The first contact is movable into communication with the second contact in a second, closed position. The first contact is also coupled to the handle. The system further includes a power actuation system in communication with and responsive to the switch and coupled to the liftgate to move the liftgate from the closed position to the opened position when the switch is in the closed position. The rotation of the handle relative to the liftgate moves the first contact into communication with the second contact to close the switch.

Further is provided a latch system for a liftgate of a motor vehicle. The system includes a latch that couples the liftgate to the motor vehicle when the liftgate is in a closed position. The system also includes a handle graspable to be rotated relative to the liftgate and in communication with the latch to uncouple the liftgate from the motor vehicle upon rotation of the handle. The system further includes a switch including a first contact, a second contact and a biasing member. The first contact is biased apart from the second contact in a first, opened position, by the biasing member, and is slidable into communication with the second contact in a second, closed position. The first contact includes a cable coupled to the handle such that rotation of the handle pulls the cable to slide the first contact into communication with the second contact. The system further includes a power actuation system in communication with and responsive to the switch to move the liftgate from the closed position to the opened position when the switch is in the second, closed position. The biasing member moves the switch into the first, opened position when the handle is released.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses. Although the following description is related generally to a liftgate latch linear cable switch for use with a liftgate of a motor vehicle, it will be understood that the linear cable switch as described and claimed herein is applicable to any type of enclosure system in which automatic opening of the enclosure system is desired. Therefore, it will be understood that the following discussion is not intended to limit the scope of the appended claims to only liftgate applications.

Figure 1:
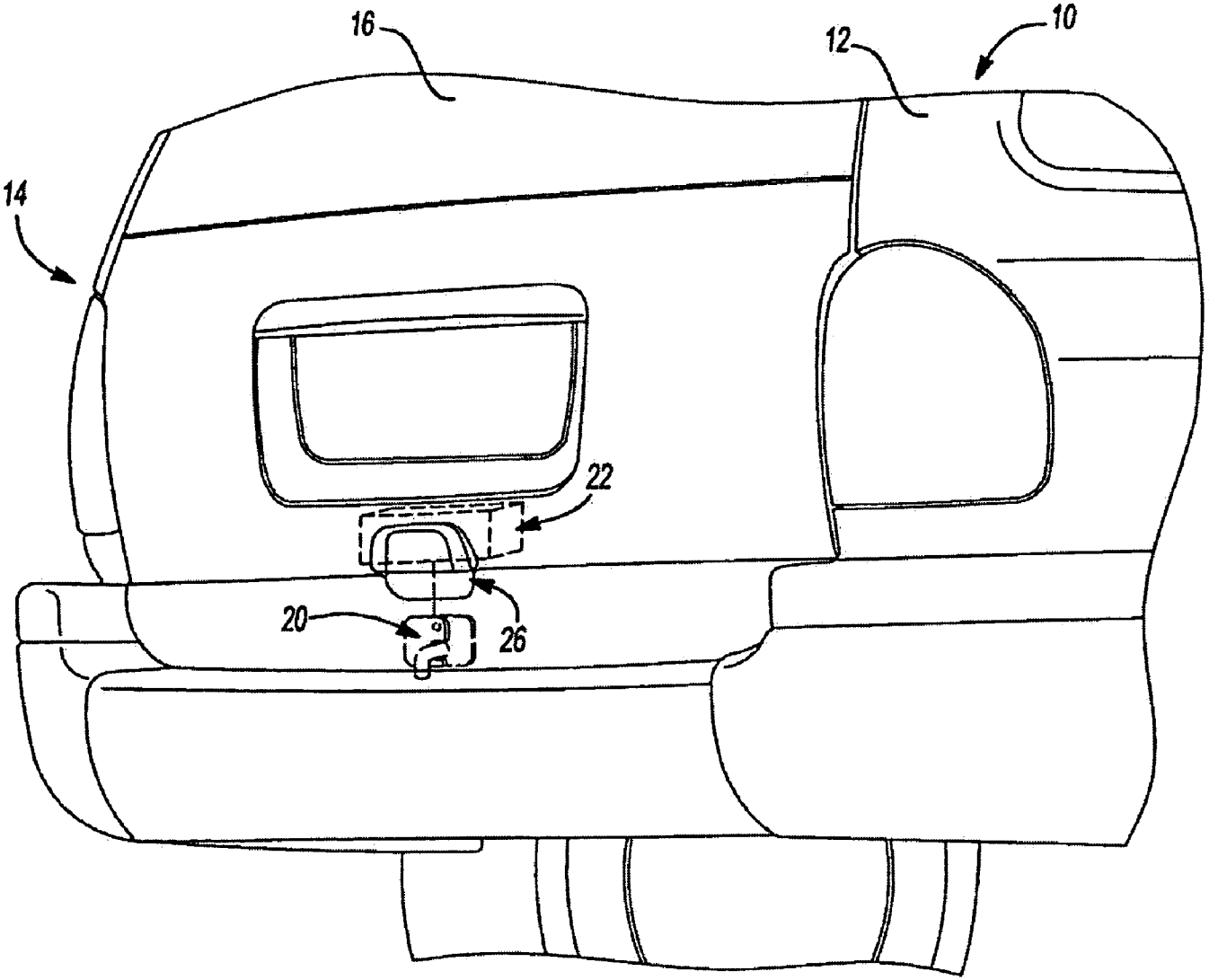
FIG. 1 is a partial schematic view of an exemplary motor vehicle employing a liftgate incorporating a liftgate latch linear cable switch according to the principles of the present disclosure with the liftgate in a closed position.
Figure 2:
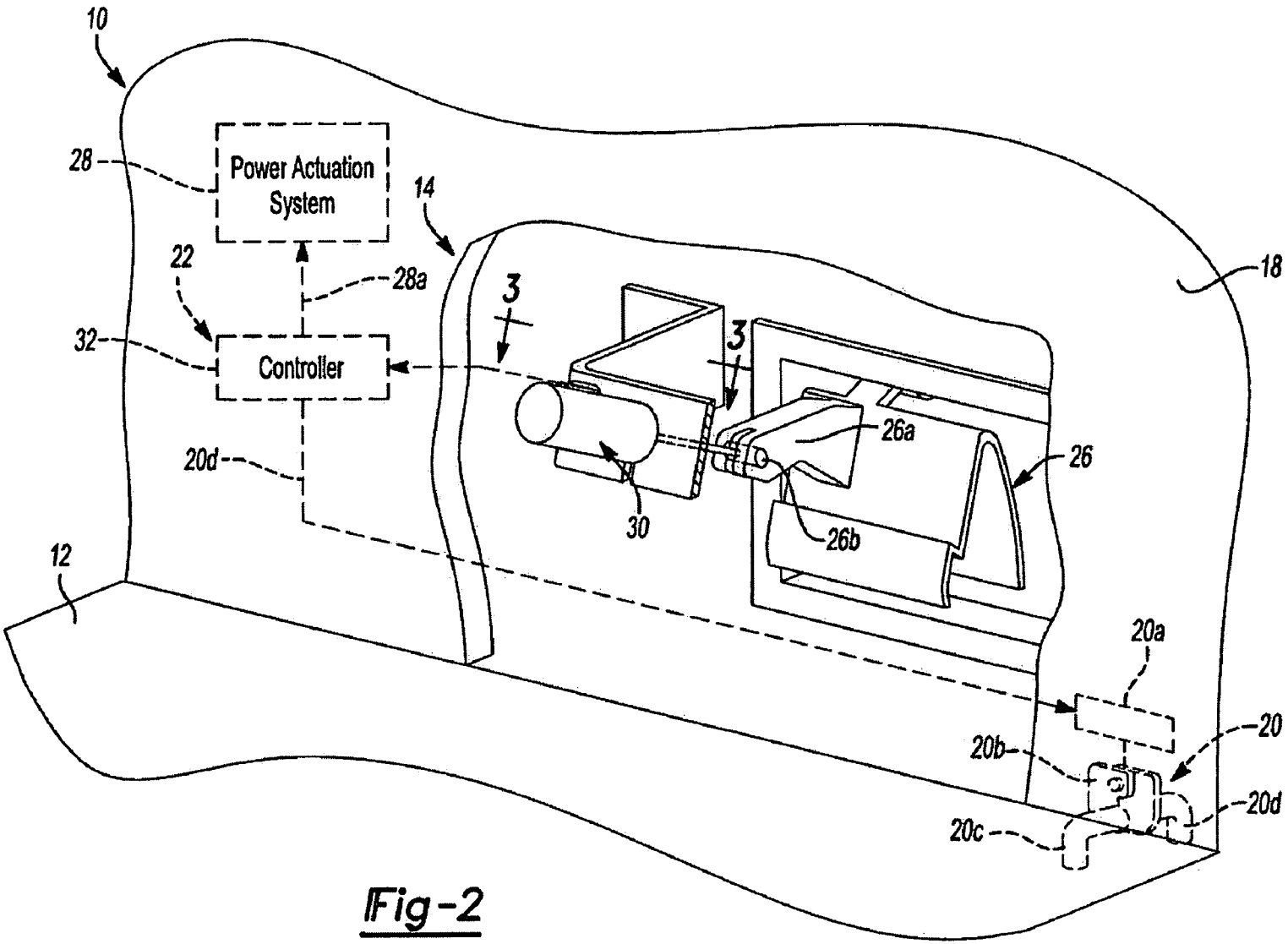
FIG. 2 is a detail view of the exemplary motor vehicle incorporating the liftgate latch linear cable switch of FIG. 1.

With reference to FIGS. 1 and 2, an exemplary portion of a motor vehicle 10 is shown. The motor vehicle 10 includes a rear cargo area 12 and a liftgate system 14. The liftgate system 14 includes at least a glass member 16, a door member 18, a latch 20 and a control system 22.

The glass member 16 and door member 18 cooperate to form a liftgate, as generally known, and the latch 20 serves to releasably secure at least the door member 18 to the motor vehicle 10. As the glass member 16 and door member 18 are generally known in the art, and may comprise any suitable rear lift door, such as that disclosed in commonly assigned U.S. Pat. No. 5,563,483 and incorporated herein by reference, the liftgate, including the glass member 16 and the door member 18, will not be discussed in great detail herein. Briefly, however, the liftgate includes a handle 26 pivotally coupled to the door member 18. The handle 26 may be manually rotated or pivoted from a first position to a second position to enable an operator to access the rear cargo area 12. The handle 26 may also include an arm **26*a* that defines a receptacle 26*b* for receipt of at least a portion of the control system 22**.

Figure 2A:
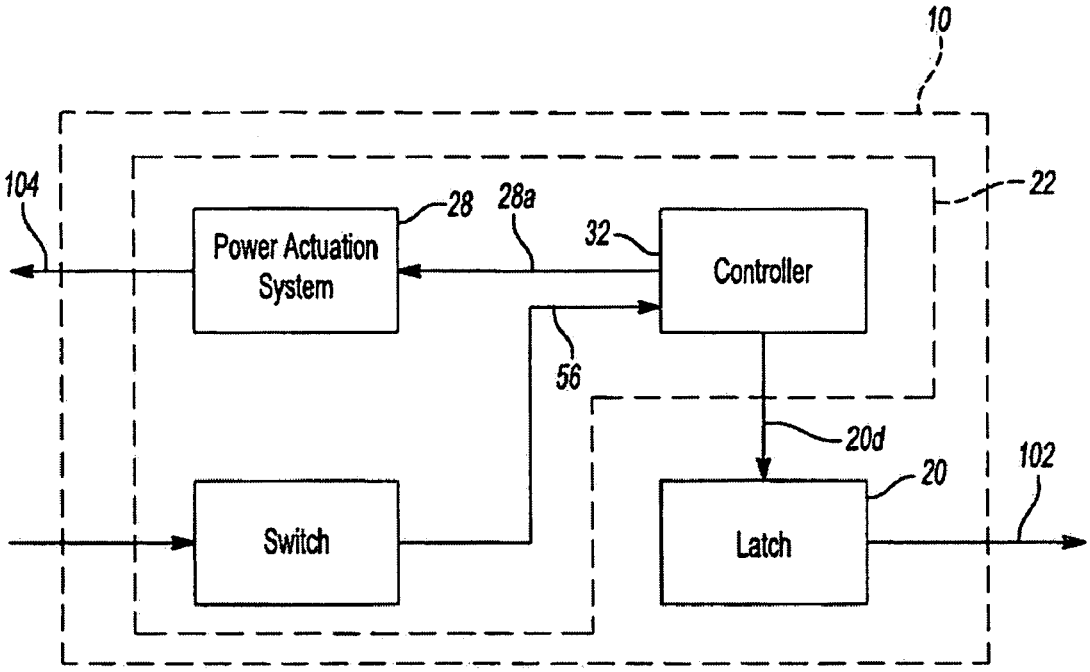
FIG. 2A is a schematic illustration of a control system for the motor vehicle of FIG. 1.

With reference to FIGS. 2 and 2A, in this regard, the control system 22 is responsive to the handle 26 to release the latch 20 and pivot the liftgate 24 from a closed position to an opened position. The latch 20 may comprise any suitable device for releasably coupling the liftgate 24 to the motor vehicle 10, and may include a solenoid 20*a* that actuates latch members 20*b* to engage or disengage a latch pin 20*c* coupled to the rear cargo area 12 of the motor vehicle 10. For example, the latch 20 could comprise a suitable latch commercially available from Gecom Corporation of Greensburg, Ind., however, any suitable latch could be employed. The solenoid 20*a* may be in communication with and responsive to the control system 22 via a conductor 20*d* to output a signal 100 to actuate the latch members 20*b* to engage or disengage the latch pin 20*c*, as generally known in the art.

With continuing reference to FIGS. 2 and 2A, the control system 22 includes a power actuation system 28, a switch 30 and a controller 32. The power actuation system 28 is in communication with and responsive to the controller 32 over a conductor 28*a* to output a signal 104 to raise, lift or move the glass member 16 and door member 18 from the closed position to the opened position, and vice versa, if desired. As the power actuation system 28 may comprise any suitable system capable of moving the glass member 16 and door member 18 between the closed position and the opened position (and vice versa), such as that disclosed in commonly assigned U.S. Ser. No. 08/292,662, incorporated herein in its entirety, the power actuation system 28 will not be discussed in great detail herein. Briefly, however, the power actuation system 28 may include the conductor 28*a* in communication with the controller 32 to conduct or carry an electrical control signal, such as an alternating current, which activates or powers a motor associated with the power actuation system 28 to move the glass member 16 and door member 18 into the opened or closed position (not specifically shown).

Figure 3:
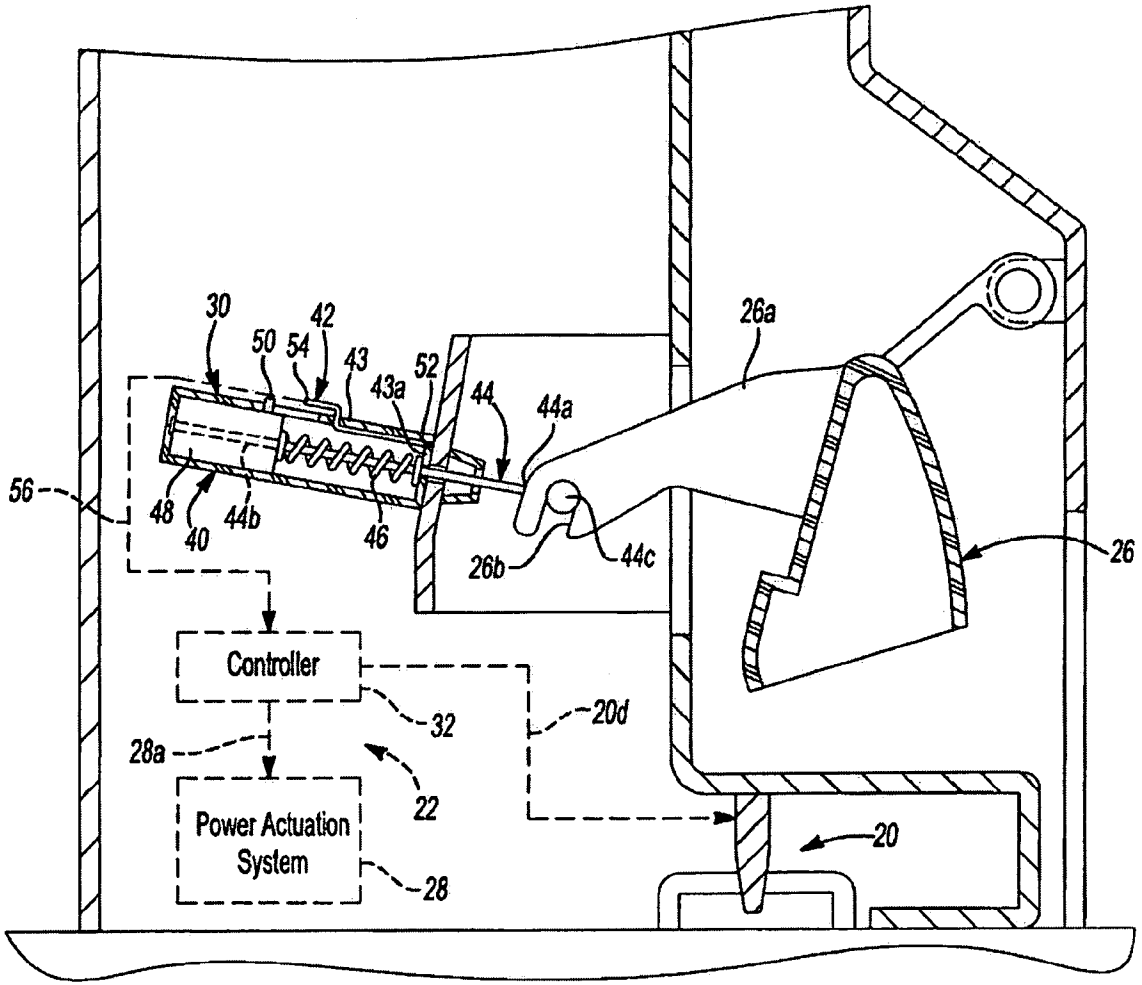
FIG. 3 is a cross-sectional schematic view of the liftgate latch linear cable switch of FIG. 1, taken along line 3-3 in FIG. 2, with the liftgate in a first position.
Figure 4:
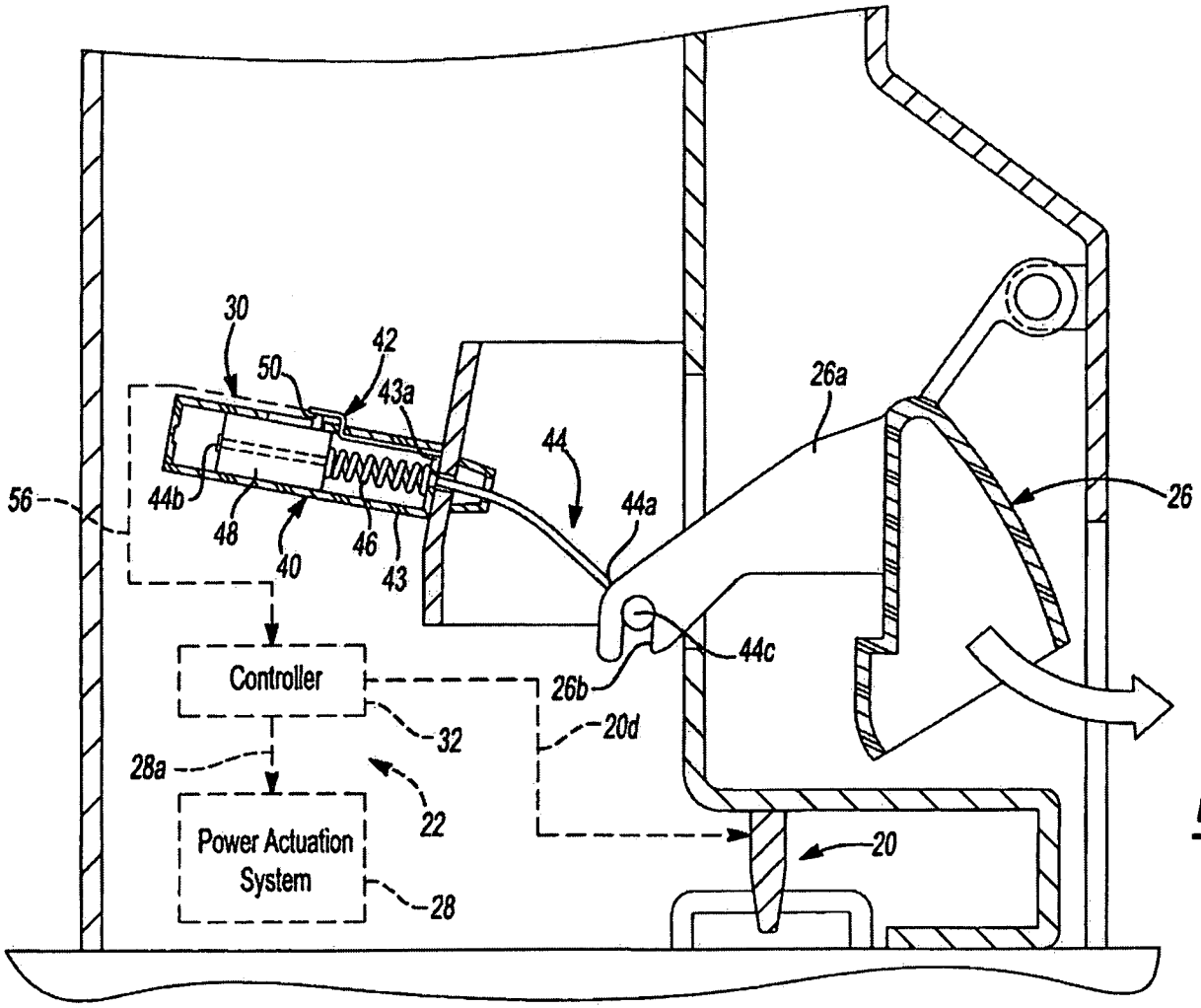
FIG. 4 is a cross-sectional schematic view of the liftgate latch linear cable switch of FIG. 1, taken along line 3-3 in FIG. 2, with the liftgate in a second position.

With reference to FIGS. 2-4, the switch 30 includes a first or bridge contact 40 and a second or trace contact 42, with each of the bridge contact 40 and the trace contact 42 disposed at least partially within a housing 43. With reference to FIGS. 3-4, the bridge contact 40 includes a cable 44, a biasing member or spring 46, contact housing 48 and contacts 50. The cable 44 may be at least partially disposed within the housing 43, and may be slideably retained in the housing 43 such that the cable 44 moves relative to the housing 43 (FIG. 4). The cable 44 includes a proximal end 44*a*, a distal end 44*b* and a grip 44*c*.

The grip 44*c* is formed at the proximal end 44*a*, and extends from the housing 43. Generally, the grip 44*c* is sized to engage the receptacle 26*b*, and may be sized to be snap fit into the receptacle 26*b* to couple the switch 30 to the handle 26. The coupling of the grip 44*c* to the handle 26 enables the switch 30 to be mechanically responsive to the pivoting of the handle 26. In this regard, the pivoting of the handle 26 pulls or slides the cable 44 relative to the housing 43, from a first or opened switch position (FIG. 3) into a second or closed switch position (FIG. 4), which moves the contacts 50 into electrical communication with the trace contact 42 to close the switch 30. The distal end 44*b* of the cable 44 is coupled to the contact housing 48, and is disposed within the housing 43.

The spring 46 is disposed about the cable 44, between the contact housing 48 and a surface 43*a* of the housing 43. The spring 46 biases the cable 44, and thus, the switch 30 into the opened position, and serves to return the switch 30 to the closed position after the pivoting or movement of the handle 26.

The contact housing 48 includes electronics associated with the contacts 50. The contacts 50 may be exposed through apertures defined in the contact housing 48. The contacts 50 include a positive contact and a negative or ground contact that are operable to enable a flow of current through the switch 30 when the contacts 50 are in communication with the trace contact 42 (i.e. when the switch 30 is closed).

The trace contact 42 includes a positive contact and a negative or ground contact. The positive contact and the ground contact each include a first end 52, respectively, and a second end 54, respectively. The first end 52 is in communication with the controller 32 to transmit an electrical signal, such as a current, when the switch 30 is in the closed position. The second end 54 is operable to be in electrical communication with the bridge contact 40. In this regard, the second end 54 may be adjacent to and in electrical communication with the contacts 50 of the bridge contact 40 when the cable 44 is in the extended position. Thus, the second end 54 may be disposed within a path of travel of the cable 44 so that when the cable 44 is moved into the extended position, the bridge contact 40 is placed into electrical communication with the trace contact 42. The electrical communication between the bridge contact 40 and the trace contact 42 closes the switch 30 so that a current may flow therethrough. The flow of the current may serve as an indicator or signal that indicates to the controller 32 that the switch 30 is in the closed position.

The controller 32 includes a conductor 56 that is in communication with the controller 32 and responsive to the trace contact 42. The conductor 56 is in electrical communication with the first end 52 of the trace contact 42 and is in electrical communication with the controller 32. The controller 32 is also in electrical communication with the latch 20 via the conductor 20*d*. The controller 32 may transmit a signal over the conductor 20*d* to the solenoid 20*a* to activate the solenoid 20*a* to engage or disengage the latch members 20*b* from the latch pin 20*c*. The controller 32 may also be in communication with the power actuation system 28, via the conductor 28*a*, to transmit the electrical control signal to activate the power actuation system 28 to move the liftgate 24 into the opened or closed position.

Thus, with at least the door member 18 in the closed position, the switch 30 is in the opened position. In order to gain access to the rear cargo area 12, an operator pivots the handle 26 of the door member 18. The pivoting of the handle 26 causes the grip 44*c* to move relative to the housing 43 of the switch 30, and thereby pulls the cable 44. The movement of the cable 44 relative to the housing 43 moves the contact housing 48 relative to the housing 43 until the contacts 50 of the bridge contact 40 are in electrical communication with the trace contact 42. Once the contacts 50 of the bridge contact 40 are in electrical communication with the trace contact 42, the switch 30 is closed. With the switch 30 in the closed position, current may flow through the conductor 32*a* to the controller 32.

Upon receipt of the current from the switch 30, the controller 32 outputs a signal to the latch 20 over the conductor 20*d* to disengage the latch members 20*b* from the latch pin 20*c*. The controller 32 also outputs the control signal to the power actuation system 28 to move at least the door member 18 from the closed position to the opened position. Once the operator has released the handle 26, the spring 46 biases the cable 44 away from the surface 43*a*, and thus, opens the switch 30.

While specific examples have been described in the specification and illustrated in the drawings, it will be understood by those of ordinary skill in the art that various changes may be made and equivalents may be substituted for elements thereof without departing from the scope of the present disclosure as defined in the claims. Furthermore, the mixing and matching of features, elements and/or functions between various examples is expressly contemplated herein so that one of ordinary skill in the art would appreciate from this disclosure that features, elements and/or functions of one example may be incorporated into another example as appropriate, unless described otherwise, above. Moreover, many modifications may be made to adapt a particular situation or material to the teachings of the present disclosure without departing from the essential scope thereof. Therefore, it is intended that the present disclosure not be limited to the particular examples illustrated by the drawings and described in the specification as the best mode presently contemplated for carrying out this disclosure, but that the scope of the present disclosure will include any embodiments falling within the foregoing description and the appended claims.

What is claimed is:

1. A latch system for a liftgate of a motor vehicle comprising:

a handle configured to be rotatable relative to the liftgate-between a first position and a second position;

a switch including a first contact biased apart from a second contact by a biasing member, the first contact movable relative to the second contact to close the switch upon rotation of the handle;

a power actuation system in communication with and responsive to the switch to move the liftgate from the closed position to the opened position when the switch is in the closed position; and a housing, with at least a portion of each of the first contact and the second contact disposed within the housing, wherein the first contact includes a contact housing and a cable, the contact housing including at least an exposed positive contact and an exposed ground contact, the contact housing being received within the housing of the switch and movable relative to the housing, the cable being coupled to the contact housing to move the contact housing, the cable extending beyond the housing of the switch and coupled to the handle, and wherein the biasing member is coupled between the contact housing and an interior of the housing.

2. The system of claim 1, wherein the handle further comprises a receptacle and the cable further comprises a grip that is received within the receptacle to couple the first contact to the handle.

3. The system of claim 2, wherein the handle is configured to be manually pivotable relative to the liftgate, and when the handle is released, the biasing member moves the contact housing to return the switch to the opened position.

4. The system of claim 3, wherein the second contact further comprises:

a positive contact coupled to a side of the housing of the switch such that the positive contact is in communication with the positive contact of the first contact when the contact housing is moved by the cable;

a ground contact coupled to the side of the housing of the switch such that the ground contact is in communication with the ground contact of the first contact when the contact housing is moved by the cable; and wherein the positive contact of the second contact is in communication with the power actuation system.

5. The system of claim 4, further comprising:

a latch that is adapted to couple the liftgate to the motor vehicle when the liftgate is in a closed position; and wherein the rotation of the handle unlatches the latch for uncoupling the liftgate from the motor vehicle.

6. The system of claim 5, further comprising:

a controller responsive to the switch and in communication with the latch to actuate the latch to unlatch the latch when the switch is closed by the rotation of the handle.

7. A latch system and a liftgate of a motor vehicle comprising:

a latch adapted to couple the liftgate to the motor vehicle when the liftgate is in a closed position;

a handle adapted to rotate relative to the liftgate and communicate with the latch to uncouple the liftgate from the motor vehicle upon rotation of the handle;

a switch including a first contact spaced apart from a second contact in a first, opened position, the first contact movable into communication with the second contact in a second, closed position, the first contact coupled to the handle;

a controller responsive to the switch and in communication with the latch to actuate the latch to unlatch the latch when the switch is closed by the rotation of the handle;

a power actuation system in communication with and responsive to the switch and coupled to the liftgate to move the liftgate from the closed position to the opened position when the switch is in the closed position; and wherein rotation of the handle moves the first contact into communication with the second contact to close the switch, wherein the switch further comprises a housing, with at least a portion of each of the first contact and the second contact disposed within the housing, wherein the first contact further comprises:

a contact housing that includes at least an exposed positive contact and an exposed ground contact, the contact housing received within the housing of the switch and movable relative to the housing;

a cable coupled to the contact housing to move the contact housing, the cable extending beyond the housing of the switch and coupled to the handle; and a biasing member coupled between the contact housing and an interior of the housing that biases the first contact apart from the second contact.

8. The system of claim 7, wherein the handle further comprises a receptacle and the cable further comprises a grip that is received within the receptacle to couple the first contact to the handle.

9. The system of claim 8, wherein the handle is manually pivotable relative to the liftgate, and when the handle is released, the biasing member moves the contact housing to return the switch to the opened position.

10. The system of claim 9, wherein the second contact further comprises:

a positive contact coupled to a side of the housing of the switch such that the positive contact is in communication with the positive contact of the first contact when the contact housing is moved by the cable;

a ground contact coupled to the side of the housing of the switch such that the ground contact is in communication with the ground contact of the second contact when the contact housing is moved by the cable; and wherein each of the positive contact and the negative contact are in communication with the power actuation system.

11. A latch system for a liftgate of a motor vehicle comprising:

a latch adapted to couple the liftgate to the motor vehicle when the liftgate is in a closed position;

a handle graspable to be rotated relative to the liftgate and in communication with the latch to uncouple the liftgate from the motor vehicle upon rotation of the handle;

a switch including a first contact, a second contact and a biasing member, the first contact biased apart from the second contact in a first, opened position, by the biasing member and slidable into communication with the second contact in a second, closed position, the first contact including a cable coupled to the handle such that rotation of the handle pulls the cable to slide the first contact into communication with the second contact;

a power actuation system in communication with and responsive to the switch to move the liftgate from the closed position to the opened position when the switch is in the second, closed position; and a housing, with at least a portion of each of the first contact and the second contact disposed within the housing, wherein the biasing member moves the switch into the first, opened position when the handle is released, and wherein the first contact includes a contact housing and a cable, the contact housing including at least an exposed positive contact and an exposed ground contact, the contact housing being received within the housing of the switch and movable relative to the housing, the cable being coupled to the contact housing to move the contact housing, the cable extending beyond the housing of the switch and coupled to the handle, and wherein the biasing member is coupled between the contact housing and an interior of the housing.

12. The system of claim 11, wherein the handle further comprises a receptacle and the cable further comprises a grip that is received within the receptacle to couple the first contact to the handle.

13. The system of claim 11, further comprising a controller responsive to the switch and in communication with the latch to actuate the latch to unlatch the latch when the switch is closed by the rotation of the handle.

* * * * *